US006592054B2

(12) United States Patent
Prus

(10) Patent No.: US 6,592,054 B2
(45) Date of Patent: Jul. 15, 2003

(54) DEVICE FOR SPRAYING COATING PRODUCT AND ROTATING SPRAY ELEMENT FOR SUCH A DEVICE

(75) Inventor: Eric Prus, Grenoble (FR)

(73) Assignee: Sames S.A., Meylan (FR)

( * ) Notice: Subject to any disclaimer, the term of this patent is extended or adjusted under 35 U.S.C. 154(b) by 0 days.

(21) Appl. No.: 09/783,293

(22) Filed: Feb. 15, 2001

(65) Prior Publication Data

US 2001/0015386 A1 Aug. 23, 2001

(30) Foreign Application Priority Data

Feb. 21, 2000 (FR) ..... 0002112

(51) Int. Cl.[7] ..... F23D 11/04; B05B 3/10; B05B 3/00; B05B 3/04; A62C 31/02

(52) U.S. Cl. ..... 239/224; 239/223; 239/220; 239/227.1; 239/DIG. 11; 239/381; 239/394

(58) Field of Search ..... 239/224, 223, 239/220, 222.17, 240, 263, 263.1, 381, 383, 394, DIG. 11

(56) References Cited

U.S. PATENT DOCUMENTS 4,373,673 A * 2/1983 Morishita et al. ..... 239/703
4,473,188 A 9/1984 Ballu
4,489,741 A * 12/1984 Ogasawara ..... 134/179
4,811,906 A * 3/1989 Prus ..... 239/703
5,104,043 A * 4/1992 Pacht ..... 239/128
5,199,167 A * 4/1993 Desazars de Montgailharo et al. ..... 29/888.02
5,584,435 A * 12/1996 Lind ..... 239/73
5,697,559 A * 12/1997 Davis et al. ..... 239/703
5,861,692 A * 1/1999 Furlani et al. ..... 310/103

FOREIGN PATENT DOCUMENTS

EP 0 662 349 A 7/1995

* cited by examiner

*Primary Examiner*—Davis Hwu
(74) *Attorney, Agent, or Firm*—Browdy and Neimark, P.L.L.C.

(57) ABSTRACT

This device comprises a rotating spray element, such as a bowl, and drive means, such as a rotor, adapted to drive said element in rotation.

It further comprises means for magnetic coupling between the rotating element and the drive means. An air-gap is formed between the coupling means which advantageously include at least one magnet associated with a looping annulus. The magnet may be fitted on the rotor and/or on the bowl.

26 Claims, 3 Drawing Sheets

DEVICE FOR SPRAYING COATING PRODUCT AND ROTATING SPRAY ELEMENT FOR SUCH A DEVICE

FIELD OF THE INVENTION

The present invention relates to a device for spraying coating product comprising a rotating spray element, such as a bowl or dish, driven in rotation at high speed by drive means such as a rotor of an air turbine. The invention also relates to a rotating spray element that may be used with this device.

BACKGROUND OF THE INVENTION

In an installation for spraying liquid or particulate coating product, it is known to spray the product by means of a bowl or a dish supplied with product and rotating at a speed of the order of 30,000 rpm. At such a speed of rotation, it is desirable that the bowl or dish be as light as possible and balanced, in order to avoid unbalance to a maximum, particularly if the drive turbine is an air-bearing and/or magnetic turbine.

It is known to assemble a rotating spray element on the rotor of a turbine by means of a threaded rod extending axially with respect to the rotor and by means of an axial tapping of the rotating element or bowl, or by bolts distributed circumferentially about the axis of rotation of this element. Such a type of assembly considerably increases the weight of the rotating assembly while the operations of assembly and dismantling are long and fastidious, which is not forcibly compatible with the times available for maintenance, particularly on an automobile vehicle production chain.

WO-A-94/12286 discloses a spraying device comprising a bowl connected to the rotor of a spray thanks to a radially expansible fitting crown. This system is satisfactory.

U.S. Pat. No. 4,473,188 discloses spreading equipment comprising a rotating nozzle driven by an electric motor. The coupling between this nozzle and the driven shaft of the motor is effected by abutment of a metal ring fast with the nozzle on a magnet driven by this shaft. Such surface abutment pre-supposes a precise positioning of the nozzle with respect to the shaft, which limits the speed of rotation of the nozzle. In addition, if metal particles are deposited on the magnet, the surface abutment of the ring is no longer possible, which hinders the coupling between the nozzle and the shaft of the motor. Moreover, the successive positionings of nozzles on the shaft may damage that surface of the magnet intended to receive the rings of the nozzles in abutment. This device is therefore not adapted for the spraying of coating product for which the bowl must be regularly cleaned and/or changed, with subsequent re-positioning of this bowl or a fresh bowl.

It is an object of the invention to propose an alternative solution to the one disclosed in WO-A-94/12286, which is particularly simple from the structural standpoint, therefore reliable and of attractive cost price, and compatible with the spraying of coating product.

SUMMARY OF THE INVENTION

To that end, the invention relates to a device for spraying coating product of the type mentioned above, which comprises means for magnetic coupling between the rotating spray element and the drive means associated therewith, and which is characterized in that an air-gap is formed between these magnetic coupling means.

Thanks to the use of magnetic coupling means, assembly and dismantling of the rotating spray element on and from its drive means are particularly rapid, since it suffices to bring the rotating element sufficiently close to the drive means for the magnetic coupling to produce an efficient effect of connection. These coupling means also allow a magnetic centering of the rotating element with respect to the rotor. As an air-gap is formed between the magnetic coupling means, there is no risk of upsetting the opposite surfaces of the coupling means, even after the bowl has been positioned several times. Moreover, a possible deposit of metal particles or of impurities on one of these opposite surfaces does not hinder operation of the couplig means. Particular precautions are therefore unnecessary for positioning a bowl.

According to a first embodiment of the invention, the rotating element is equipped with at least one magnet adapted to cooperate with a magnetic looping element borne by the drive means.

According to another advantageous embodiment of the invention, the drive means are equipped with at least one magnet adapted to cooperate with a magnetic looping element borne by the rotating element.

According to a third embodiment of the invention, the rotating element and the rotor are each provided with a magnet, the polarities of these magnets being oriented so that a force of attraction is generated between these magnets when the rotating element is mounted on the rotor.

Whatever the embodiment considered, the permanent magnet may be in the form of an annulus or a sector of annulus centred on the axis of rotation of the rotating element. In a variant embodiment, a plurality of magnets in the form of sectors of annulus or of studs are distributed about the axis of rotation. Similarly, the looping element may be a metal annulus centred on the axis of rotation of the rotating element.

According to another advantageous aspect of the invention, the magnet and/or the looping element is force-fitted in a housing made in the rotating element or in the drive means.

According to another advantageous aspect of the invention, the device comprises mechanical means for centering the rotating spray element with respect to the drive means. These centering means allow a pre-positioning of the magnetic coupling means during positioning of the spray element on the drive means. These centering means also contribute to the correct hold of the spray element on its drive means. In that case, the rotating element may be provided to comprise at least one truncated surface bearing against a corresponding truncated surface of the drive means. A truncated surface of the rotating element is advantageously formed substantially around the magnetic coupling means. In addition, a truncated surface of the drive means may be provided to be formed at the level of a free edge of a skirt defining a volume for partially receiving the rotating element.

According to another advantageous aspect of the invention, the magnetic coupling means also constitute means for self-centering the rotating element on the rotor, which makes it possible to envisage total or partial elimination of the mechanical centering means.

The invention also relates to a rotating spray element or bowl capable of being used with a device as described hereinbefore and which bears means adapted to cooperate with complementary means provided on a drive member for connecting the bowl and the member in question by magnetic coupling, while the bowl is provided with a bearing surface against a corresponding surface of this member in such a position that an air-gap is formed between the above-mentioned magnetic coupling means which cooperate.

BRIEF DESCRIPTION OF THE DRAWINGS

The invention will be more readily understood on reading the following description of two embodiments of a device for spraying coating product in accordance with its principle, given solely by way of example and made with reference to the accompanying drawings, in which.

DESCRIPTION OF PREFERRED EMBODIMENTS

Figure 1:
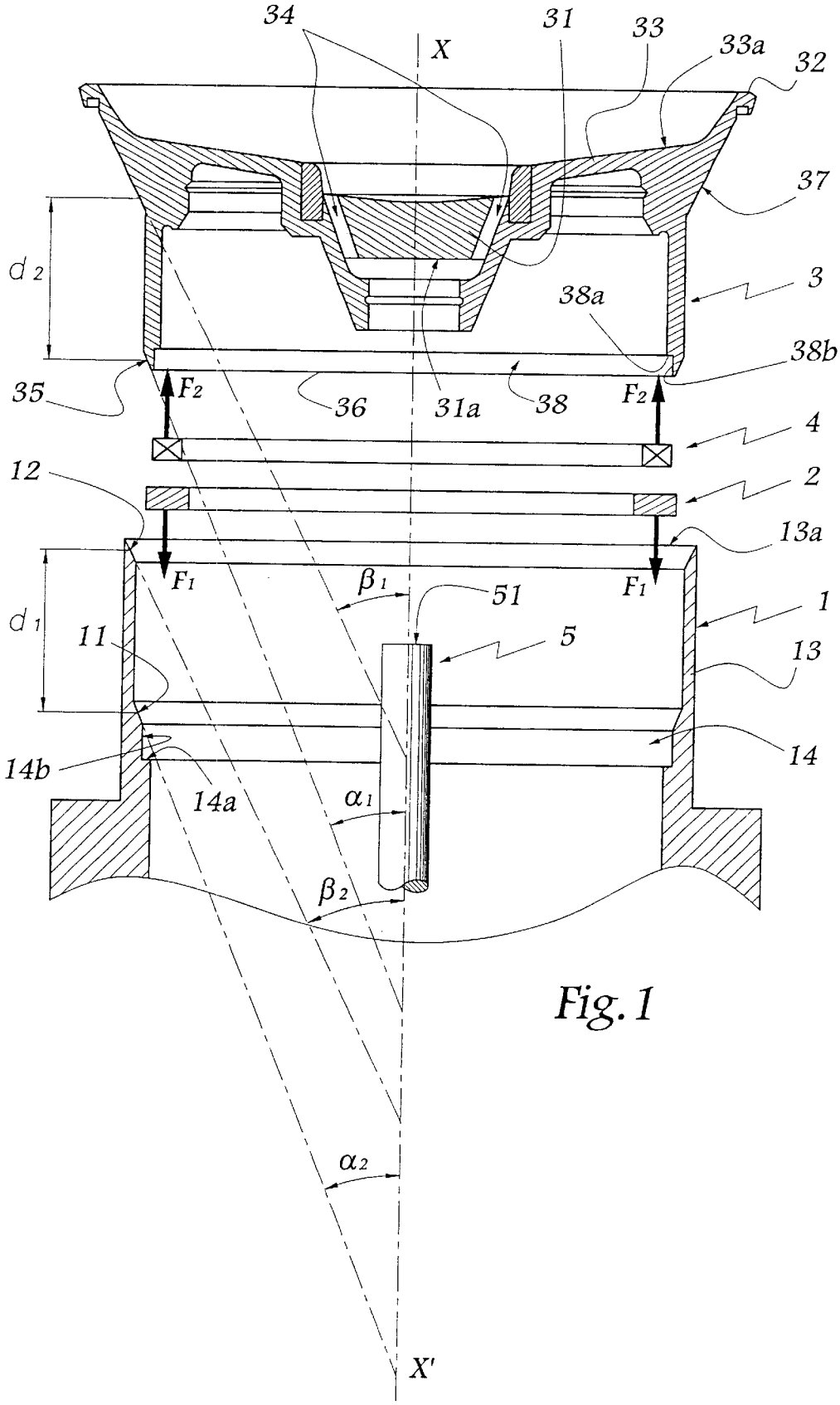
FIG. 1 is an axial section through a spraying device according to a first embodiment of the invention, in the course of assembly.
Figure 2:
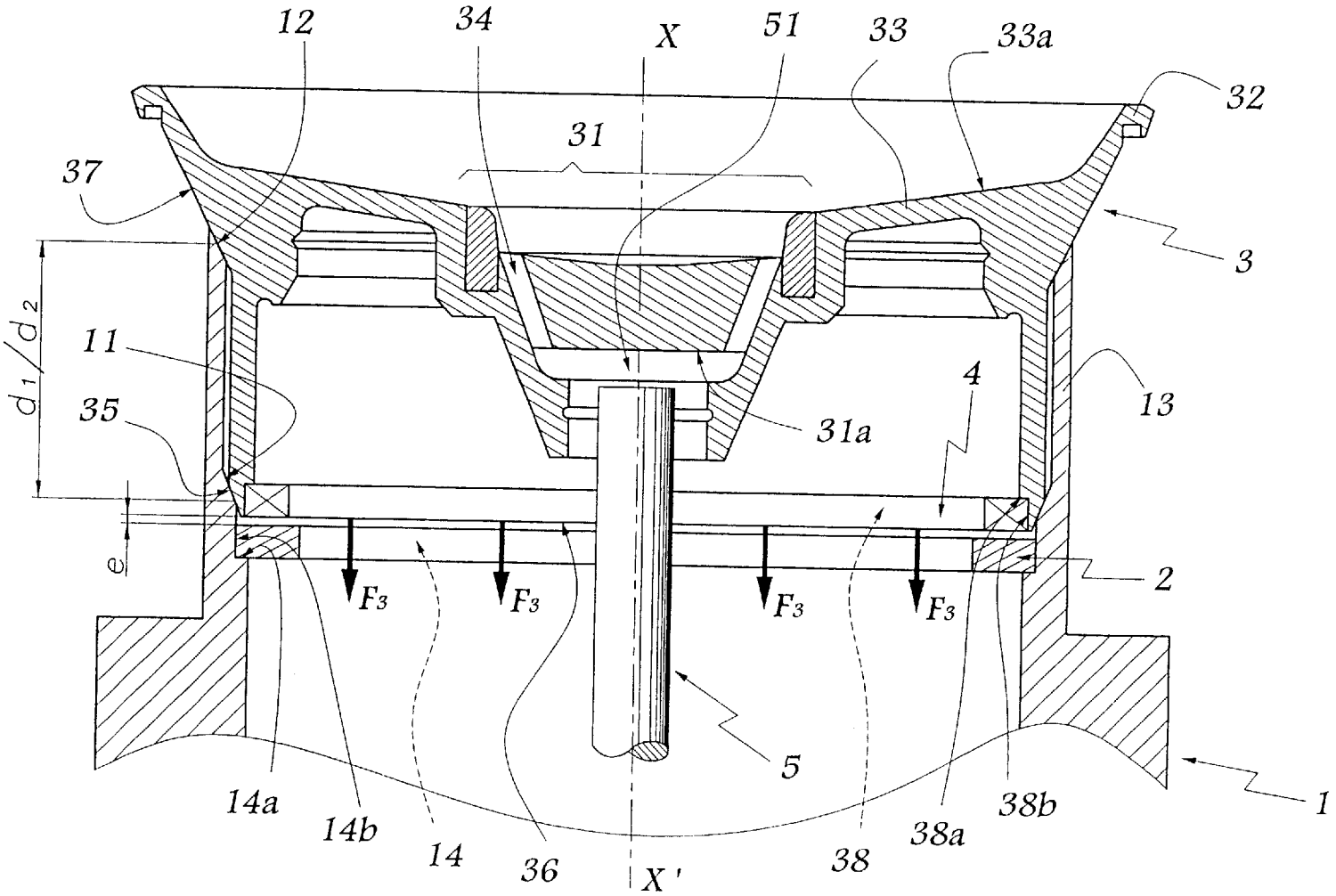
FIG. 2 is an axial section through the device of FIG. 1, assembled.

Referring now to the drawings, FIGS. 1 and 2 partially show the rotor 1 of an air bearing turbine. It is symmetrical about its axis of rotation X–X' and forms two truncated surfaces 11 and 12 likewise centered on the axis X–X' and widening outwardly of the turbine to which the rotor 1 belongs, i.e. towards the front of the spraying device of the invention.

Taking into account its mode of drive by an air bearing turbine, the rotor 1 may attain speeds of rotation of several tens of thousands of revolutions per minute, for example of the order of 30,000 rpm, and even of 80,000 rpm for a so-called "high velocity" turbine.

In the present specification, the terms "front" and "rear" are to be understood with respect to an operational configuration of the device, the front side being oriented towards the object to be coated, while the rear side is oriented away from it.

The rotor 1 forms a substantially cylindrical skirt 13 centered on axis X–X', the surface 12 being formed at the level of the free edge 13*a* of the skirt 13, radially inside this free edge.

The rotor 1 also forms a housing 14 for receiving an annulus 2 made of soft iron. The housing 14 comprises a shoulder 14*a* and an outer radial surface 14*b* against which the annulus 2 is force-fitted as represented by arrows $F_1$ in FIG. 1, the annulus 2 being immobilized in the housing 14 by cooperation of shapes.

A bowl 3 is intended to be mounted on the rotor 1 in order to be driven in rotation at high velocity about axis X–X'. This bowl comprises a central part 31 intended to be arranged in the interior volume of the skirt 13 opposite the opening 51 of a tube 5 supplying the bowl 3 with coating product, this tube 5 likewise being centred on axis X–X'. The tube 5 allows axial supply of the bowl 3 by its rear side. The central part 31 of the bowl 3 is connected to a spray edge 32 by a web 33 over which the coating product is distributed by centrifugation. Channels 34 made in part 31 allow the coating product to flow from the rear face 31*a* of part 31 towards the front face 33*a* of the web 33, then towards the edge 32.

A first truncated surface 35 is provided at the level of the rear edge 36 of the bowl 3, outside it, this surface 35 being convergent in upstream direction of the tube 5. The angle $\alpha_1$ of aperture of the surface 35 about axis X–X' is substantially equal to the angle $\alpha_2$ of aperture of the surface 11 about this same axis, with the result that a surface bearing of surface 35 on surface 11 may be envisaged.

The bowl 3 also forms a second truncated surface 37 likewise convergent towards the axis X–X' in upstream direction of the tube 5 and of which $\beta_1$ denotes the angle of aperture. This angle is substantially equal to angle $\beta_2$ of aperture of the surface 12 about axis X–X'.

The distance d1 between the median zones of the surfaces 11 and 12 is substantially equal to the distance $d_2$ between the median zones of the surfaces 35 and 36, with the result that a simultaneous abutment of surfaces 35 and 37 respectively on surfaces 11 and 12 may be obtained. In practice, the cooperation of the surfaces 35 and 11 on the one hand, 37 and 12 on the other hand, makes it possible, by the orientation of these surfaces, to obtain a centering of the bowl 3 on axis X–X'. A guiding or pre-positioning might also be obtained with one set of cooperating surfaces 35 and 11 or 37 and 12.

According to the invention, the bowl 3 is equipped with a permanent magnet 4 of annular shape which is mounted in a housing 38 made at the level of the rear edge 36 of the bowl 3. The housing 31 forms a shoulder 38*a* and a substantially cylindrical radial surface 38*b* which allow a force-fit of the magnet 4 in the housing 38 as represented by arrow $F_2$.

The magnet 4 is annular, but an annulus comprising a plurality of permanent magnets might also be used in place of magnet 4. According to another alternative, a plurality of magnets in the form of studs may be distributed to the rear of the bowl 3, for example three magnets distributed at 120°.

When the bowl 3 is mounted on the rotor 1 as shown in FIG. 2, the magnet 4 is disposed opposite the soft iron annulus 2, an air-gap e being formed due to the bearing of the surface 35 and 37 on the surfaces 11 and 12.

Figure 3:
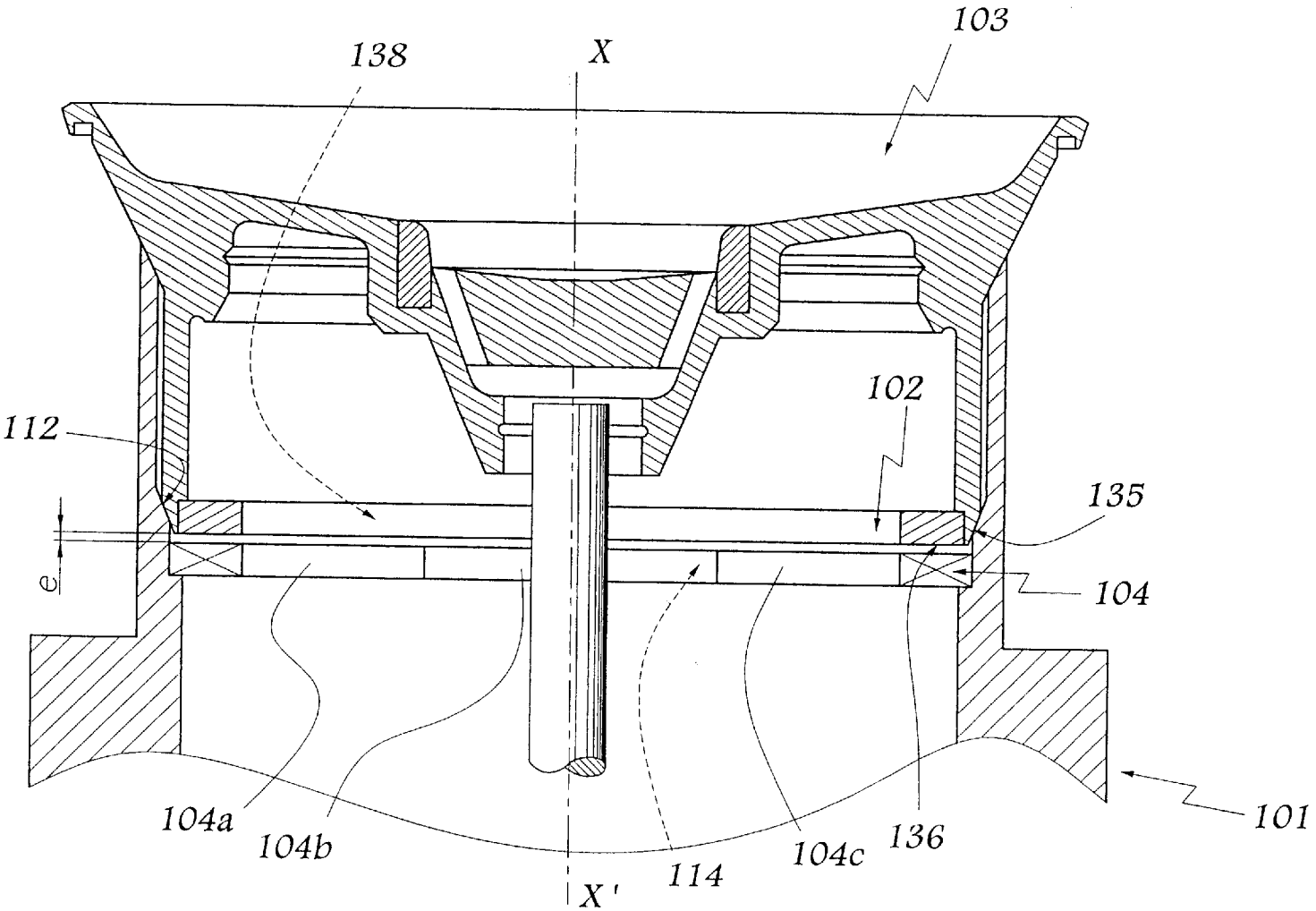
FIG. 3 is a view similar to FIG. 2 for a device according to a second embodiment of the invention.

Elements 2 and 4 enable an intense magnetic coupling to be effected between the rotor 1 and the bowl 3, the annulus 2 allowing the magnetic field generated by the magnet 4 to be closed. In this way, an effort of attraction represented by arrow $F_3$ in FIG. 3 is obtained, this effort contributing to applying the surfaces 35 and 37 strongly on surfaces 11 and 12, which contributes to an immobilization, axial and in rotation, of the bowl 3 with respect to the rotor 1. The bowl 3 is immobilized in rotation with respect to the rotor 1 thanks to the forces of friction between their surfaces in contact. In addition, it is possible to envisage a blockage of the bowl 3 on the rotor 1 in rotation, by a mechanical device, for example of the key type.

When the bowl 1 is positioned on the rotor 3, it suffices for an operator to bring the bowl 3 close to the rotor 1 using the surfaces 11, 12, 35 and 36 as guiding means until the air-gap e between the magnet 4 and the annulus 2 is sufficiently small for the force of magnetic attraction between the elements 2 and 4 to apply the bowl 3 firmly on the rotor 1.

The shape of the surfaces 12 and 35 defines the width of the air-gap e.

The magnetic coupling elements 2 and 4 are disposed around tube 5. In other words, the device of the invention is compatible with an axial or central supply of the bowl with coating product, by its rear side.

When the bowl 3 is to be dismantled with respect to the rotor 1, it suffices to exert on the bowl 3 an effort of extraction substantially parallel to axis X–X' and opposite the effort of magnetic attraction represented by arrows $F_3$.

No specific tool is necessary, the assembly and dismantling of the bowl 3 being particularly simple and rapid operations.

In the second embodiment of the invention shown in FIG. 3, elements similar to those of the first embodiment bear identical references increased by 100.

The bowl 103 of this embodiment is intended to be mounted on a rotor 101 of an air turbine. The bowl 103 is equipped with an annulus 102 of soft iron, fitted in a housing 138 made near the rear edge 136 of the bowl 103. The rotor 101 is equipped with an annulus 104 formed by a plurality of magnets 104*a,* 104*b,* 104*c*, . . . in the form of sectors of annulus.

Annulus 104 is received in a housing 114 formed inside the rotor 101.

Like elements 2 and 4, elements 102 and 104 have substantially the same radius, with the result that they provide an efficient magnetic coupling between the bowl 103 and the rotor 101, an air-gap e being formed therebetween.

Truncated surfaces 112 and 135 are respectively provided on the rotor 101 and the bowl 103. They define the relative position of the elements 101 and 103 under the effect of the attraction exerted by the coupling elements 102 and 104. In particular, the width of the air-gap e depends on the position of these surfaces.

This embodiment presents the particular advantage that the annulus 104 which constitutes the active part of the means for magnetic coupling between the rotor and the bowl is housed inside the rotor 101, with the result that it is protected against possible impurities, there being no risk of the annulus 102 attracting metallic particles or filings when it is dismantled and stored outside the spraying installation to which the device of the invention belongs.

This embodiment further provides the possibility of the magnets 104*a,* 104*b,* 104*c,* of the annulus 104 being electromagnets controlled by appropriate means mounted on the rotor 101. This makes it possible to activate these magnets or not, as a function of the assembly or dismantling of the bowl 103.

It is also possible to provide in this second embodiment one sole electromagnet of annular shape, similarly to what is described with reference to the first embodiment of the invention.

The annuli 2 and 102 may be in one piece or made of a plurality of pieces. They are made of metal, preferably soft iron, steel or another ferromagnetic material.

According to a variant embodiment of the invention (not shown), two permanent magnets may be used for effecting the magnetic coupling. One magnet is mounted on the bowl, while the second is mounted on the rotor, the polarities of these magnets being oriented in order to obtain an attraction of one magnet with respect to the other when the bowl is mounted on the rotor. In fact, in that case, the magnetic looping element which is constituted by the annuli 2 and 102 of the embodiments described, is constituted by the second magnet.

Whatever the embodiment considered, the means for magnetic coupling between the bowl and the rotor, which are essentially symmetrical about the axis of rotation of the rotor and of the bowl, allow the bowl to be self-centred on the rotor.

What is claimed is:

1. Device for spraying coating product, comprising a rotating spray element (3; 103) that is rotatable about an axis and that is balanced with respect to the axis, drive means (1; 101) adapted to rotate in order to drive said element in rotation about the axis, and means (2, 4; 102, 104) for magnetic coupling between said rotating element and said drive means, wherein an air-gap (e) is formed between said magnetic coupling means (2, 4; 102, 104) and said magnetic coupling means (2, 4; 102, 104) rotate together with said rotating element and said drive means.

2. The device of claim 1, wherein said rotating element (3) is equipped with at least one magnet (4) adapted to cooperate with a magnetic looping element (2) borne by said drive means (1).

3. The device of claim 2, wherein said magnet (4) is in the form of an annulus or sector of annulus centred on the axis of rotation (X–X') of said rotating element (3).

4. The device of claim 2, wherein it comprises a plurality of magnets in the form of sectors of annulus (104*a,* 104*b,* 104*c*) or of studs distributed about the axis of rotation (X–X') of said rotating element (3).

5. The device of claim 2, wherein said looping element is a metallic annulus (2) centred on the axis of rotation (X–X') of said rotating element (3).

6. The device of claim 2, wherein said magnet (4) and/or said looping element (2) is force-fitted against an outer radial surface (14*b*) of a housing (14, 38) made in said rotating element (3) or in said drive means (1).

7. The device of claim 1, wherein said drive means (101) are equipped with at least one magnet (104*a,* 104*b*, 104*c*) adapted to cooperate with a magnetic looping element (102) borne by said rotating element (103).

8. The device of claim 7, wherein said magnet (104*a,* 104*b,* 104*c*) is in the form of an annulus or sector of annulus centred on the axis of rotation (X–X') of said rotating element (103).

9. The device of claim 7, wherein it comprises a plurality of magnets in the form of sectors of annulus (104*a,* 104*b,* 104*c*) or of studs distributed about the axis of rotation (X–X') of said rotating element (103).

10. The device of claim 7, wherein said looping element is a metallic annulus (102) centred on the axis of rotation (X–X') of said rotating element (103).

11. The device of claim 7, wherein said magnet (104*a*, 104*b*, 104*c*) and/or said looping element (102) is force-fitted against an outer radial surface (14*b*) of a housing (114, 138) made in said rotating element (103) or in said drive means (101).

12. The device of claim 1, wherein said rotating element and said drive means are each provided with a magnet, the polarities of said magnets being oriented so that a force of attraction is generated between said magnets when said rotating element is mounted on said rotor.

13. The device of claim 12, wherein said magnet is in the form of an annulus or sector of annulus centred on the axis of rotation of said rotating element.

14. The device of claim 12, wherein it comprises a plurality of magnets in the form of sectors of annulus or of studs distributed about the axis of rotation (X–X') of said rotating element.

15. The device of claim 1, wherein it comprises mechanical means (11, 12, 35, 37) for centering said rotating spray element (3; 103) with respect to said drive means (1; 101).

16. The device of claim 15, wherein said rotating element (3; 103) comprises at least one truncated surface (35, 37) bearing against a corresponding truncated surface (11, 12) of said drive means (1; 101).

17. The device of claim 16, wherein said truncated surface (35) of said rotating element (3; 103) is arranged substantially around said magnetic coupling means (2, 4; 102, 104).

18. The device of claim 17, wherein said truncated surface (12) of said drive means (1; 101) is arranged at the level of a free edge (13*a*) of a skirt (13) defining a volume for partially receiving said rotating element (3; 103).

19. The device of claim 16, wherein said truncated surface (12) of said drive means (1; 101) is arranged at the level of a free edge (13*a*) of a skirt (13) defining a volume for partially receiving said rotating element (3; 103).

20. The device of claim 1, wherein said magnetic coupling means (2, 4; 102, 104) constitute means for self-centering said rotating spray element (3; 103) on said rotor (1; 101).

21. Rotating spray element adapted to be used in a device according to claim 1 and bearing means (4; 102) adapted to cooperate with complementary means (2, 104) provided on a drive member (1; 101) for connection of said element (3; 103) and said member by magnetic coupling, wherein said element is provided with a surface (35; 135) bearing against a corresponding surface (12; 112) of said member in a position such that an air-gap (e) is formed between said magnetic coupling means which cooperate.

22. The device of claim 1, wherein said rotating element is axially symmetrical relative to the axis.

23. The device of claim 22 wherein said drive means constitute means for driving said element in rotation at a speed at least equal to several tens of thousands of revolutions per minute.

24. The device of claim 1, wherein said drive means constitute means for driving said element in rotation at a speed at least equal to several tens of thousands of revolutions per minute.

25. The device of claim 1, wherein said rotating element has an annular surface from which coating product is sprayed and which is symmetrical with respect to the axis.

26. Device for spraying coating product, comprising a rotating spray element (3; 103) that is rotatable about an B axis and that is balanced with respect to the axis, rotatable drive means (1; 101) that are rotatable to drive said element in rotation about the axis, and means (2, 4; 102, 104) providing a magnetic coupling of said rotating element to said drive means for holding said rotating element in position relative to said drive means, wherein an air-gap (e) is formed between said magnetic coupling means (2, 4; 102, 104).

* * * * *